US007597083B1

(12) United States Patent
Nachtman

(10) Patent No.: US 7,597,083 B1
(45) Date of Patent: Oct. 6, 2009

(54) OIL PAN TO ENGINE BLOCK ATTACHMENT FOR AVOIDING FRETTING OF THE OIL PAN RIM

(75) Inventor: James B. Nachtman, Westchester, IL (US)

(73) Assignee: International Engine Intellectual Property Company LLC, Warrenville, IL (US)

( * ) Notice: Subject to any disclaimer, the term of this patent is extended or adjusted under 35 U.S.C. 154(b) by 0 days.

(21) Appl. No.: 12/184,705

(22) Filed: Aug. 1, 2008

(51) Int. Cl.
*F02B 77/00* (2006.01)

(52) U.S. Cl. ..... 123/195 C; 184/6.5

(58) Field of Classification Search ..... 123/195 C, 123/196 R; 184/6.5, 6.6
See application file for complete search history.

(56) References Cited

U.S. PATENT DOCUMENTS 4,615,314 A * 10/1986 Baugh ..... 123/195 C
4,619,343 A * 10/1986 Lengenfelder ..... 123/195 C

* cited by examiner

*Primary Examiner*—Noah Kamen
(74) *Attorney, Agent, or Firm*—Jack D. Nimz; Jeffrey P. Calfa

(57) ABSTRACT

A clamp (26) has a main body (30) that is attached to an engine block (28). A right-angled flange (32) extends from the main body to enter a downwardly open concave interior of an outturned flange (18) of an oil pan rim (16) and provides underlying support for an insert (46) on which the outturned flange of the oil pan rim rests. Fretting of the rim is avoided because the presence of the insert avoids any substantial contact between the flange (32) and the rim (16) that could lead to fretting.

10 Claims, 1 Drawing Sheet

OIL PAN TO ENGINE BLOCK ATTACHMENT FOR AVOIDING FRETTING OF THE OIL PAN RIM

FIELD OF THE INVENTION

This invention relates to internal combustion engines, in particular the interface between the block and oil pan at the engine crankcase.

BACKGROUND OF THE INVENTION

A typical construction for both V- and I-type engines comprises a metal oil pan that is attached to the block so that the two cooperate to form the bottom of an engine crankcase that includes an oil sump. The oil pan has an upper perimeter rim that bounds an interior of the oil pan, and it is via that rim that the pan is attached to the block. A sealing gasket is disposed between the oil pan rim and a surface of the block to seal the joint between them.

In certain engines, clamps are used for the attachment of the oil pan to the block. A typical clamp is fastened to the block by a screw and is shaped to engage the rim of the pan so that as the screw is being tightened into the block, the rim is forced toward the block, compressing the gasket in the process. In order to protect the metal of the oil pan from corrosion, the pan is typically coated with a rust preventive.

The inventor has observed occurrences of fretting of the oil pan at the pan/block interface in certain engines that use clamps for attaching the pan to the block at various locations around the rim of the oil pan. Such occurrences can lead to premature failure of the interface that leads to oil leaking from the crankcase at the interface. The inventor has also observed that the onset of an incipient fretting failure is caused by the clamp wearing through the rust-preventive coating at a location where the clamp engages the pan rim and exposing bare metal of the pan to corrosion. As corrosion accelerates, a fretting fatigue crack or excessive oil pan material loss allows an oil leak to develop.

SUMMARY OF THE INVENTION

The present invention relates to a cost-effective solution for avoiding such failures that comprises a modification to a portion of the clamp that allows for the use of an insert that provides an interface between the clamp and the oil pan rim so that it becomes impossible for the clamp to create wear in the rim that could eventually lead to a failure. Even if some fretting were ever to occur between the clamp and the insert, the pan rim would not be affected.

The invention provides an improved pan/block interface at the locations where clamps are used for the attachment of the pan to the block. The inserts are the only additional parts that are used and only a portion of a prior clamp requires modification for use with an insert. The oil pan rim incorporates features to retain the inserts prior to engine assembly.

The inserts are circular steel rods curved as needed to match curvature in the profile of the oil pan rim at certain attachment locations. The modification to the prior clamp provides a concave surface for engaging slightly less than a semi-circumference of the insert. An opposite semi-circumference of the insert is disposed against a downwardly open concave surface of the rim. In this way the clamp cannot act on the oil pan rim in a way that could lead to a fretting failure.

One general aspect of the present invention relates to an internal combustion engine comprising a block and an oil pan cooperating to form a bottom of an engine crankcase that includes an oil sump. The oil pan comprises an upper perimeter rim bounding an interior of the oil pan. The upper perimeter rim comprises an outturned flange that is exterior to the pan's interior and that has a downwardly open concave interior. One or more clamps clamp the upper perimeter rim of the oil pan to the block at various locations around the rim.

Each clamp comprises a main body that is attached to the block and a flange that extends from the main body to enter the downwardly open concave interior of the outturned flange of the oil pan rim and provide underlying support for an insert on which the outturned flange of the oil pan rim rests.

Another general aspect relates to a method for attaching an oil pan to an engine block to form a bottom of an engine crankcase that includes an oil sump.

The method comprises placing an insert within a downwardly open concave interior of an upper perimeter rim of the oil pan formed by an outturned flange on the pan's exterior, engaging a distal end of a flange that extends from a main body of a clamp with the insert, and attaching the main body of the clamp to the block.

The foregoing, along with further features and advantages of the invention, will be seen in the following disclosure of a presently preferred embodiment of the invention depicting the best mode contemplated at this time for carrying out the invention. This specification includes drawings, now briefly described as follows.

DESCRIPTION OF THE PREFERRED EMBODIMENT

Figure 1:
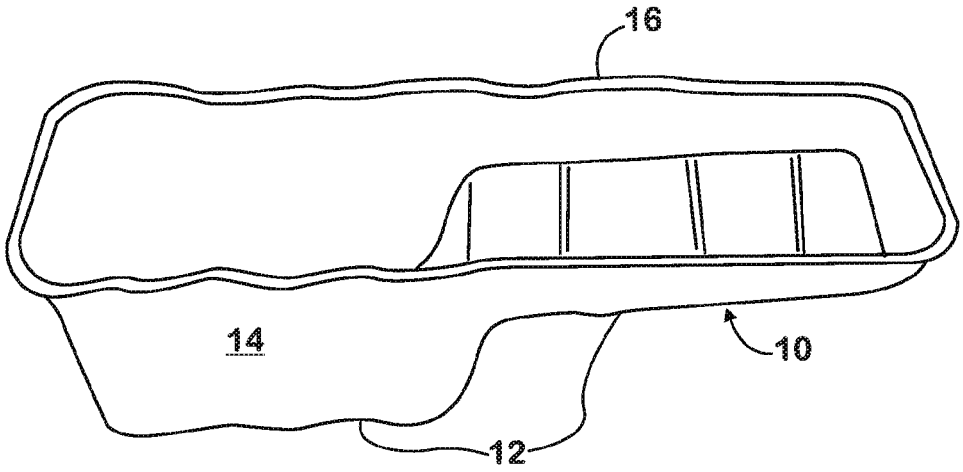
FIG. 1 is a perspective view of an oil pan by itself, generally from one side of the pan.
Figure 2:
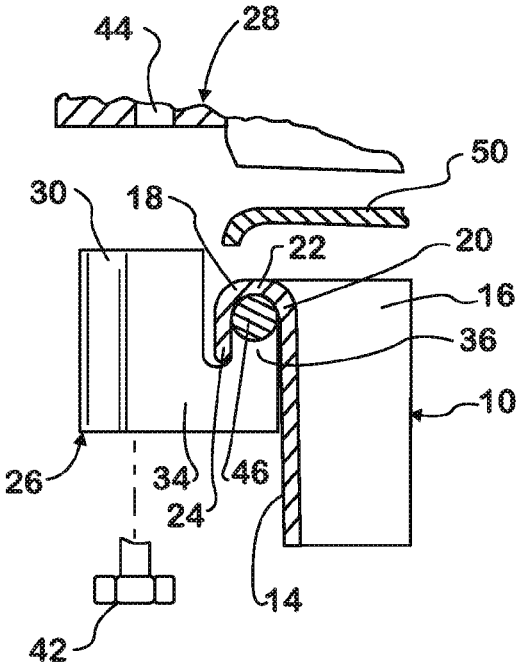
FIG. 2 is a vertical cross section view, partially exploded, through the rim of the oil pan showing various parts involved in attaching the oil pan to the rim in accordance with principles of the present invention.

FIGS. 1 and 2 show an oil pan 10 having a bottom wall 12 and a generally upright side wall 14 bounding the interior of the oil pan. Side wall 14 has an endless upper perimeter rim 16 that comprises an outturned flange 18 on the exterior of the pan's interior. Flange 18 and an upper margin 20 of side wall 14 provide rim 16 with a downwardly open concave interior defined by upper margin 20 and a generally semi-circular portion 22 of flange 18 that at one limit of its circumferential extent merges with upper margin 20 and at an opposite circumferential limit merges with a generally vertical end margin 24 of flange 18. Pan 10 is a formed metal part that has a rust-preventive coating.

At various locations around rim 16, a respective clamp 26 attaches oil pan 10 to an engine block 28. The oil pan and the block cooperatively form the bottom of an engine crankcase, including an oil sump within the interior of the pan. Each clamp 26 comprises a main body 30 and a generally right-angled flange 32 that extends from main body 30 to enter the downwardly open concave interior of rim 16 on the exterior of the crankcase.

Figure 3:
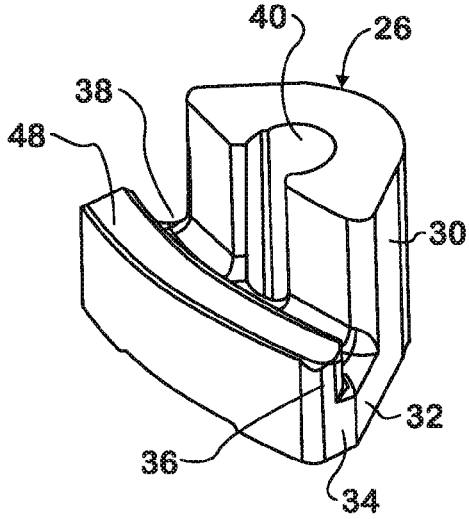
FIG. 3 is a perspective view of one of the parts in FIG. 2 shown by itself on a slightly larger scale.

Flange 32 comprises a base 34 that supports a ridge 36 that is separated from main body 30 by a channel 38. As seen in FIG. 3, ridge 36, channel 38, and the face of main body 30 that confronts ridge 36 are curved to match curvature of rim 16 at a particular attachment location where the rim is curved.

Main body 30 contains a central circular through-hole 40 that along a small arc at the face that confronts ridge 36 is open toward the ridge. As oil pan 10 is being attached to block 28, the shank of a headed screw 42 is passed through through-hole 40 and threads to a hole 44 in block 28 to fasten clamp 26 to the block while the clamp associates with the oil pan.

Clamp 26 associates with oil pan 10 in a manner that avoids the fretting that was discussed earlier. FIG. 2 shows detail of the rim/clamp interface where a rod forms an insert 46 that is disposed between ridge 36 and flange 18. Insert 46 has a circular transverse cross section and a curved length that conforms to the curvature of channel 38. Flange 18 has, at the top of ridge 36, an upwardly concave distal end surface 48 that is circularly contoured to fit to slightly less than a semi-circumference of insert 46. The generally semi-circular portion 22 of flange 18 fits to an opposite semi-circumference of insert 46. Insert 46 is thereby captured within the downwardly open concave interior of rim 16 to locate and constrain ridge 36 relative to rim 16 such that it becomes impossible for ridge 36 to create wear in the rim that could eventually lead to a failure.

During the process of assembling oil pan 10 to block 28, clamp 26 is located to align its through-hole 40 with hole 44 in block 28 while end surface 48 of ridge 36 is engaging insert 46 and the insert is captured within the downwardly open interior of pan rim 16, the shank of screw 42 is passed through through-hole 40 and threaded in hole 44. A sealing gasket 50 disposed between rim 16 and a surface of block 28 is compressed as screw 42 is tightened.

While a presently preferred embodiment of the invention has been illustrated and described, it should be appreciated that principles of the invention apply to all embodiments falling within the scope of the following claims.

What is claimed is:

1. An internal combustion engine comprising:

a block and an oil pan cooperating to form a bottom of an engine crankcase that includes an oil sump;

the oil pan comprising an upper perimeter rim bounding an interior of the oil pan;

the upper perimeter rim comprising an outturned flange that is exterior to the pan's interior and that has a downwardly open concave interior; and one or more clamps for clamping the upper perimeter rim of the oil pan to the block;

each such clamp comprising a main body that is attached to the block and a flange that extends from the main body to enter the downwardly open concave interior of the outturned flange of the oil pan rim and provide underlying support for an insert on which the outturned flange of the oil pan rim rests.

2. An engine as set forth in claim 1 wherein the insert has a downwardly convex surface, and the flange of the clamp has an upwardly concave distal end surface on which the downwardly convex surface of the insert rests.

3. An engine as set forth in claim 2 wherein the insert has an upwardly convex surface opposite its downwardly convex surface, and the downwardly open concave interior of the outturned flange of the oil pan rim rests on the upwardly convex surface of the insert.

4. An engine as set forth in claim 3 wherein the upwardly convex and the downwardly convex surfaces of the insert lie on a common imaginary circle.

5. An engine as set forth in claim 4 wherein the insert comprises a metal rod having a circular circumference lying on the imaginary circle.

6. An engine as set forth in claim 5 wherein the insert has a curved length that is concave in a direction toward the interior of the oil pan.

7. An engine as set forth in claim 1 including a sealing gasket disposed to seal between the upper perimeter rim of the oil pan and a surface of the block.

8. An engine as set forth in claim 1 wherein the main body comprises a through-hole, and further including a screw that passes through the through-hole and threads into a hole in the block to attach the clamp to the block.

9. An engine as set forth in claim 1 wherein the oil pan comprises a metal having a rust-preventive coating covering a surface that is exterior to the oil pan's interior including the downwardly open concave interior of the outturned flange of the oil pan rim, and the insert comprises metal that is in surface-to-surface contact with the coating on the downwardly open concave interior of the outturned flange.

10. A method for attaching an oil pan to an engine block to form a bottom of an engine crankcase that includes an oil sump, the method comprising:

placing an insert within a downwardly open concave interior of an upper perimeter rim of the oil pan formed by an outturned flange on the pan's exterior;

engaging a distal end of a flange that extends from a main body of a clamp with the insert;

and attaching the main body of the clamp to the block.

* * * * *